US006074599A

United States Patent [19]

Murty et al.

[11] Patent Number: 6,074,599

[45] Date of Patent: Jun. 13, 2000

[54] AIR QUENCHING CHAMBER

[75] Inventors: Sanjay K. Murty, Canton; William F. Rohlin, Jackson; Mark H. Sedmak, Howell, all of Mich.

[73] Assignee: Ghafari Associates, Inc., Dearborn, Mich.

[21] Appl. No.: 09/119,035

[22] Filed: Jul. 20, 1998

[51] Int. Cl.[7] ..... C21B 7/10; C21D 1/06

[52] U.S. Cl. ..... 266/46; 266/259; 432/77

[58] Field of Search ..... 266/44, 46, 259; 432/77

[56] References Cited

U.S. PATENT DOCUMENTS

H777 5/1990 Natarajan .
3,507,712 4/1970 Scott .
4,121,954 10/1978 Dewsnap et al. .
4,582,301 4/1986 Wunning ..... 266/259
4,610,435 9/1986 Pfau et al. ..... 266/259
5,094,013 3/1992 Martin et al. ..... 432/77
5,173,124 12/1992 Baxter et al. .

*Primary Examiner*—Scott Kastler
*Attorney, Agent, or Firm*—Young & Basile, P.C.

[57] ABSTRACT

An air quenching system for cooling heated parts under controlled conditions having cooling air ejection nozzles located in opposed relation on opposite sides of the heated part and air exhaust orifices adjacent the air supply nozzles for quickly removing the cooling air after engagement with the heated part. The cooling air, and exhausting thereof, may be controlled in various zones spaced along the length of the air quenching system for controlling air flow and the rate of cooling.

9 Claims, 2 Drawing Sheets

AIR QUENCHING CHAMBER

BACKGROUND OF THE INVENTION

1. Field of the Invention

The invention pertains to air quenching systems for heated parts characterized by its ability to uniformly cool the heated part throughout its configuration and regulate the rate of cooling during air quenching.

2. Description of the Related Art

Metal parts, usually formed of steel alloys, are commonly heat treated to improve the wear and strength characteristics of the part. The heat treating of metals is highly complex with the resultant wear and strength characteristics being determined by the percentages of carbon and other materials within the steel, or other metal, the rate of cooling, and the composition of the cooling medium. It is common to cool heated parts by the use of an oil bath quench wherein the part is rapidly cooled and the heat treatment characteristics are determined by the variables mentioned above.

While oil bath quenching is commonly used for heat treatment purposes, it is also common to use an air quench or cooling chamber utilizing moving air, to cool the heated part. Air quenching has the advantage of producing a slower cooling of the part than achieved with an oil bath quench, or the like, but, henceforth, it has been difficult to control air quenching procedures other than varying the length of time that the heated part remains in the cooling air stream.

When heat treating certain steels, particularly forgings, to produce critical parts, such as the connecting rods of internal combustion engines, in order to achieve the desired strength and wear characteristics, the selection of the steel composition is important, as is the heat treatment. The durability and strength of a part such as an engine connecting rod depends on the formation of carbon or carbide into a fine grain whose particles are rounded. Grain formation is achieved by elevating the steel temperature above 2200° F. wherein the carbide readily disburses throughout the steel, followed by slow cooling to atmospheric temperature. Slow cooling such as produced in air quenching systems produces the required pearlite grain structure necessary to achieve the desired connecting rod characteristics. To rapidly quench engine connecting rods in an oil bath produces a martensite grain which is significantly harder and more brittle than the pearlite grain structure desired.

Previously, air quenching systems have not been available wherein the heated part can be uniformly cooled by air, and wherein the rate of cooling during the cooling process could be closely controlled to consistently achieve the desired metal grain structure.

OBJECTS OF THE INVENTION

It is an object of the invention to produce an air quenching system wherein the heated part is simultaneously cooled on opposite sides to produce a uniform cooling of the part mass to achieve uniform grain structure throughout the part.

An additional object of the invention is to produce an air quenching system for heated parts wherein cooling air is simultaneously ejected upon opposite sides of the heated part and is quickly exhausted to minimize errant airflow currents in the air quenching chamber and cooling may be accurately regulated and controlled.

A further object of the invention is to provide an air quenching system for uniformly cooling heated parts throughout their mass and wherein the rate of cooling while in the quenching chamber may be regulated by controlling the rate of air flow upon the part.

Yet another object of the invention is to provide an air quenching system utilizing a conveyor belt supporting the heated part to be cooled which moves through a cooling chamber and the chamber is divided into zones having various cooling rates wherein movement of the heated part through the chamber zones closely controls the rate of cooling, and hence, the heat treat characteristics of the heated part.

SUMMARY OF THE INVENTION

An air quenching system in accord with the invention basically consists of similar upper and lower portions, the upper portion being vertically superimposed above the lower portion in a spaced relationship. A movable conveyor belt extends between the upper and lower portions for supporting the heated part to be cooled as it moves between the chamber portions during cooling.

The upper portion of the upper chamber portion and the lower portion of the lower chamber portion constitute air supply manifolds, and the lower chamber portion of the upper portion and the upper chamber portion of the lower portion constitute exhaust air manifolds. The lower surface of the upper chamber portion and the upper surface of the lower chamber portion have orifices defined therein wherein some of the orifices receive air supply tubes having an end in communication with the associated air supply chamber manifold and an inner end extending through the associated lower surface of the upper portion and the upper surface of the lower portion. Nozzles located within the inner ends of the air supply tubes form the air flowing through the tubes as it is injected in the spacing between the upper and lower chamber portions and upon the part to be cooled. Preferably, the exhaust air orifices are defined intermediate the air supply tubes.

The air supply chamber portions are supplied with pressurized air through a conduit system which, in the disclosed embodiment, utilizes three air supply branches each having an air pump in the form of a fan controlled by a variable frequency drive. The air supply branches communicate with the air supply manifolds by ports, and two ports are associated with each air supply duct branch. In this manner, six air supply ports are spaced along the length of the air quenching chamber in the direction of the heated part movement and by controlling the rate of the fan operation, and by the use of dampers, the rate of air supply into the air supply manifolds can be varied along the length of the air quench chamber to produce zones permitting a higher volume of air to be initially ejected upon the heated part, and a lower volume of air can be ejected on the heated part as it approaches the quenching chamber exit. In this manner, the rate of cooling of the part can be controlled to regulate the grain structure of the cooled part.

In a similar manner, the air exhaust system includes three branches each having a variable frequency drive fan located therein, and the exhaust branches communicate with the exhaust manifold through ports spaced along the manifold length. The exhaust system fans create a vacuum within the exhaust chamber manifolds drawing the air ejected from the air tubes into the orifices defined in the air chamber surfaces quickly removing the air which has been heated by the heated part and thereby maintaining an accurate control of the flow and temperature of the exhaust air. The exhaust air rate may also be controlled by zones throughout the length of the air quenching system by regulating the fan speed and by the use of dampers controlling the air through the air exhaust ports communicating between the air exhaust manifolds and branches.

The conveyor extending between the upper and lower chamber portions includes many openings as to be freely air pervious. Preferably, the conveyor belt is formed of an open chain link metal configuration, or the like, which is flexible for passing around the conveyor rollers, and permits air to flow therethrough with no resistance. In this manner, the air being ejected through air tubes and nozzles of both the upper and lower chamber portions will directly engage the upper and lower sides, respectively, of the heated part permitting the heated part to be quickly and uniformly cooled.

The zone control of the cooling air, and the injecting of the cooling air upon opposite sides of the heat part produce a degree of control in an air quenching system not previously attainable, and the rapid removal of the heated exhaust air from adjacent the part being cooled permits a control of the rate of air quenching not previously known.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
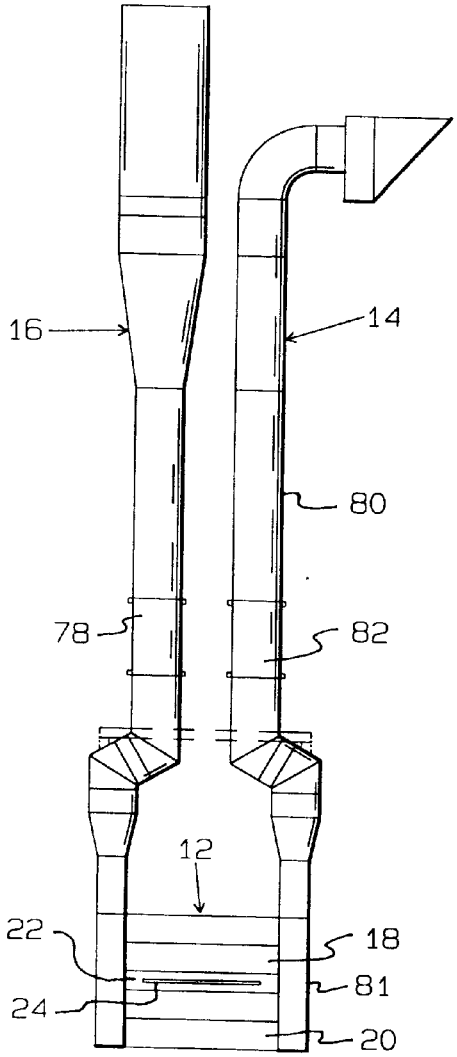
FIG. 1 is an elevational view of a cooling chamber in accord with the invention as taken from the exit end of the chamber.

The air quenching chamber in accord with the invention is usually mounted within an enclosure or housing generally represented at 10, and the air quench chamber 12 is located within this housing. The air quench chamber 12 requires a cooling air supply system generally indicated at 14 and an air exhaust system generally indicated at 16, FIGS. 1 and 2. The upper end of the air supply and air exhaust systems 14 and 16 will normally extend through the roof of the building enclosing the housing 10, and the upper end of the system 14 normally includes a baffle or air guide which prevents the entrance of rain, while the upper end of the exhaust system 16 may include a dust collector or filter to comply with environmental regulations.

Figure 2:
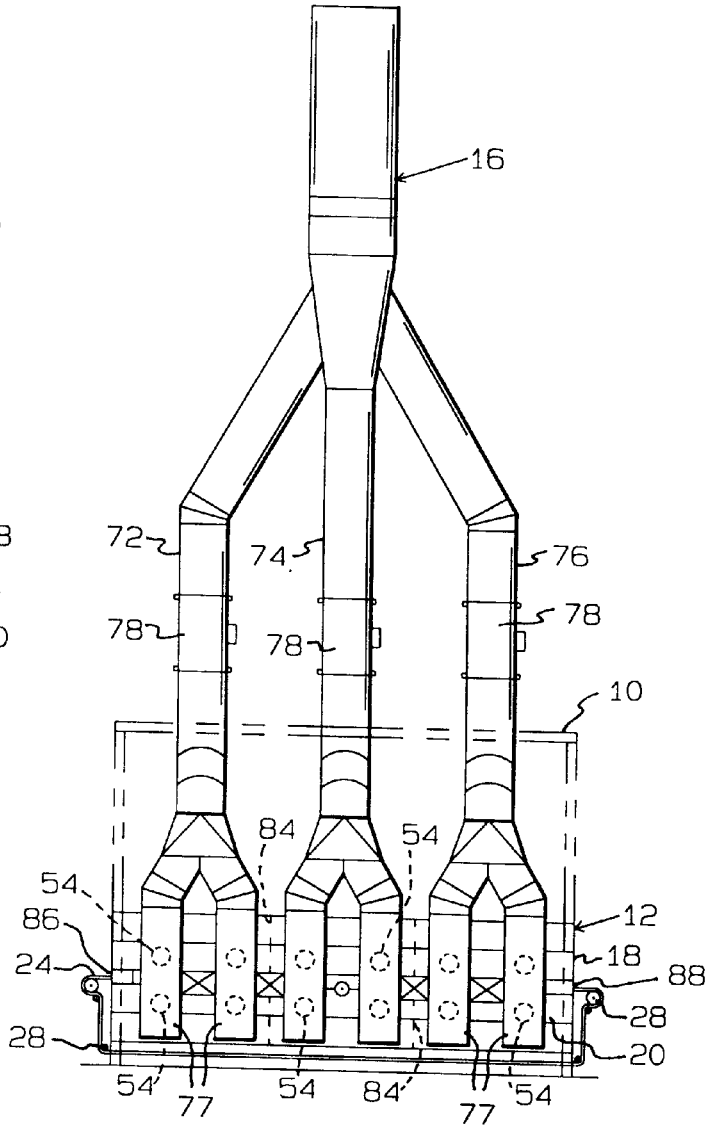
FIG. 2 is a side elevational view of an air quench cooling chamber in accord with the invention illustrating the air exhaust duct system as taken from the left of FIG. 1.
Figure 3:
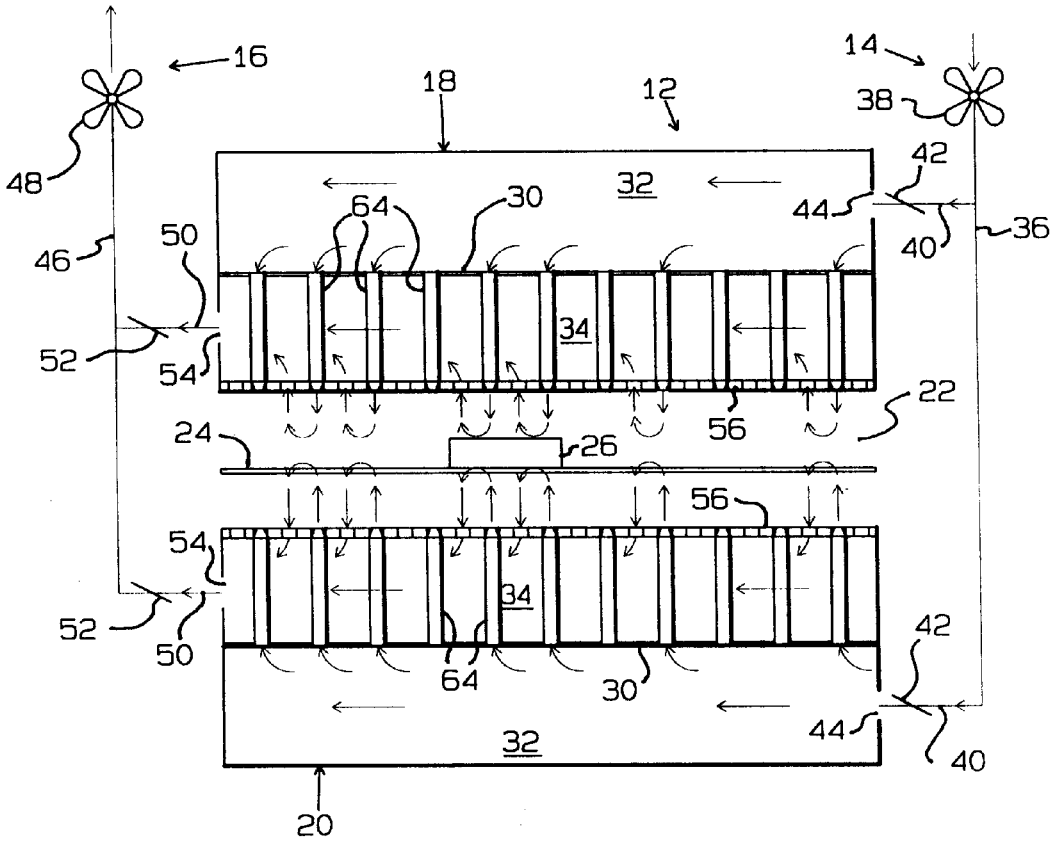
FIG. 3 is a schematic view taken transversely through the length of the cooling chamber.

As best illustrated in FIG. 3, the air quenching chamber 12 consists of identical upper and lower chamber portions 18 and 20, respectively. The portions 18 and 20 are vertically related, with the portion 18 being directly above the portion 20 wherein a vertical spacing 22 exists between the upper and lower chamber portions. Within the spacing 22, an endless conveyor 24 is located upon which the heated part to be cooled, indicated at 26, is supported. The conveyor 24 is supported upon rollers 28, FIG. 2, and the conveyor is driven by a conventional motor drive system, not shown. The conveyor 24 is air pervious as the cooling air from the lower chamber portion 20 must pass therethrough, and the conveyor 24 may include a plurality of openings, or may be formed of an open flexible material such as chain link or the like.

Both the upper chamber portion 18 and the lower chamber portion 20 are horizontally divided by plates 30, FIG. 3, wherein approximately one-half of the volume of a chamber portion exists on each side of the associated plate 30.

With reference to FIG. 3, the chamber portions located the greatest distance from the conveyor 24 constitute air supply manifolds 32, while the portion of the chambers closest to the conveyor 24 constitute air exhaust manifolds 34. The air supply conduits 36 include a variable speed fan insert 38, FIG. 3, and pressurized air from the air supply system 14 passes through conduit branches 40 and volume control dampers 42 through ports 44 whereby the air supply manifolds 32 will be pressurized by the fan 38.

The air exhaust conduit 46, FIG. 3, includes a variable speed drive fan 48, and the exhaust air passes through the air exhaust manifolds 34 through conduit branches 50 whose volume may be controlled by dampers 52. The ports 54 defined in the air exhaust manifolds 34 establish communication between the exhaust manifolds and the air exhaust system 16.

The innermost surface of the air quench chamber upper portion 18 and innermost surface of lower portion 20, i.e. the surfaces closest to the conveyor 24, is defined by inner plates 56 which define the lower surface of the upper chamber portion 18 and the upper surface of the lower chamber portion 20.

Figure 4:
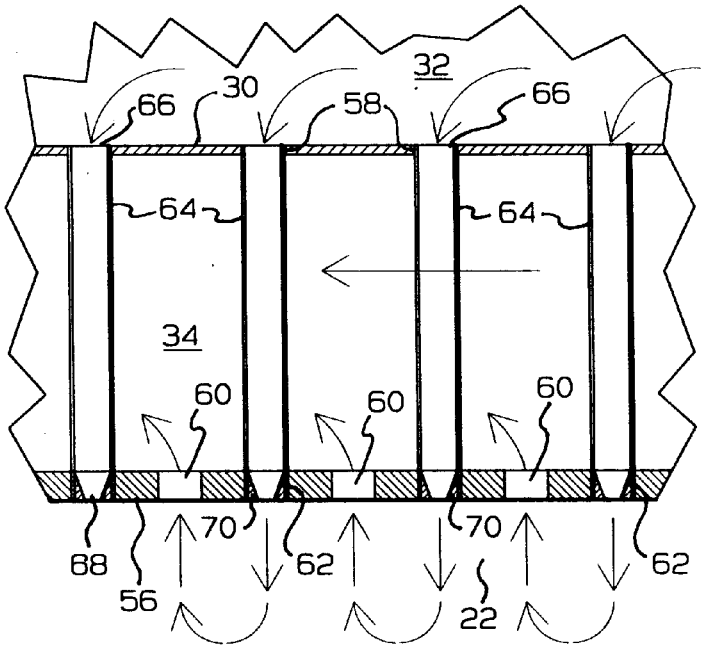
FIG. 4 is an enlarged elevational detail sectional view taken through the upper chamber portion illustrating the air supply and air exhaust manifold and air tubes.

The inner plates 30 separating the upper and lower chamber portions 18.and 20 into air supply and air exhaust manifolds each include a plurality of circular holes 58, FIG. 4, and the inner plates 56 of the chamber portions include a plurality of exhaust air orifices 60. Additionally, the plates 56 include a plurality of circular holes 62 in vertical alignment with the holes 58 as will be appreciated from FIG. 4.

A plurality of cylindrical air tubes 64 are interposed between the plates 30 and 56. The air tube inlet end 66 is received within the plate holes 58, while the air tube exit end 68 is received within the holes 62 defined in the plates 56. A conical nozzle 70 is located within the air tube exit ends 68 for shaping and constricting the air flowing through the tubes 64.

As will be appreciated from FIG. 4, the air tube inlet ends 66 are in communication with the air supply manifold 32 of the associated air quench chamber portion, and the air tube exit 68 and nozzle 70 communicates with the spacing 22 located between the upper and lower chamber portions 18 and 20 for directing air toward both the upper and lower portions of the conveyor 24 and the heated part 26 supported upon the conveyor. The general air flow paths are indicated by arrows in FIGS. 3 and 4.

In the disclosed embodiment, cooling air is introduced into the air supply manifolds 32 at six separate locations spaced along the length of the air quench chamber 12, and the exhaust air is removed from the air exhaust manifolds 34 at six locations longitudinally spaced along the air quench chamber. The distribution of the air to and from the air quench chamber is best illustrated in FIG. 2 wherein the air quench chamber air exhaust system 16 is illustrated in elevation. The air exhaust system 16 branches into three exhaust duct branches 72, 74 and 76, and these branches, in turn, each branch into a pair of lower ducts 77 disposed adjacent the sides of the air quench chamber 12 wherein the lower duct 77 communicate with the exhaust manifolds 34 through short duct branches as schematically represented at 50 in FIG. 3 through volume dampers schematically represented at 52 whereby the air within the lower ducts 77 is introduced into the exhaust manifolds 34 throughout the air chamber length through the ports 54 illustrated in dotted lines in FIG. 2.

Each of the vertical duct branches 72, 74 and 76 includes a fan insert 78 in which an electric fan is located having a variable frequency drive wherein the speed of the fan can be regulated and between the fan speed control, and the volume dampers 52, the rate of exhausting of air through each of the duct branches 77 and 72, and 76 can be closely regulated.

The air supply system 14 duct system is similar to that previously described with respect to the air exhaust system. The vertical air supply duct 80, FIG. 1, branches into three duct branches which, in turn, separate into lower duct branches 81 similar to the lower ducts 77 in the exhaust system.

The air supply for the system 14 is provided by a fan insert 82, FIG. 1, containing a variable frequency drive motor wherein each of the primary three branches of the air supply system 14 can be closely controlled,. and in conjunction with the dampers 42, the air flow into the air supply manifolds 32 through the ports 44 can be closely regulated.

In operation, the air flow characteristics into the air supply manifolds 32 will be determined by adjusting the rate of air moved by the fan inserts 82, three in number, and the setting of the volume dampers 42. Similarly, the rate of air exhausting from the air exhaust manifolds 34 will be determined by the rate of air flow as pre-selected through the fan inserts 78 and the dampers 52. Usually, in air quenching processes, it is desirable to, initially, produce a more rapid rate of cooling of the heated part, and thereafter reduce the rate of cooling to closely control the grain growth within the heated part 26 during cooling. This regulation of the rate of cooling is determined by the rate of flow of cooling air through the system 14 and the exhausting of the air through the exhaust system 16 as adjusted by the fans within inserts 82 and 78, and the adjustment of the dampers 42 and 52. In effect, the air supply manifolds 32 and air exhaust manifolds 34 will be divided into zones along the length of the air quench chamber 12, such zones being determined by the rate the air is forced into the air supply manifolds 32 and removed from the air exhaust manifolds 34. It is desirable that the rate of air introduced and removed into each zone be substantially the same in order to eliminate "back pressure"0 or cause excessive air to flow longitudinally within the spacing 22. With the embodiment shown in FIG. 2, it is possible to create as many as six "zones" in view of the six duct branches 77.

As will be appreciated from FIGS. 3 and 4, the air exhaust orifices 60 are located intermediate the air tubes 64, and the preferred air flow from the air tubes and through the orifices 60 will be as indicated by the arrows in FIGS. 3 and 4. Preferably, air injected into the spacing 22 and upon the heated part 26 is quickly removed from the proximity of the heated part, and in this manner, the rate of cooling can be closely regulated.

With reference to FIG. 2, the air quench chamber 12 includes an inlet 86 defined in the housing 10 at the conveyor 24 whereby the heated part 26 may be placed upon the conveyor 24. Upon the part passing through the air quench chamber 12, the heated part is discharged through the exit 88. Accordingly, the rate of air flow through the duct 72 will usually be greater than the rate of air flow through the duct 74, and the air flow through duct 74 will usually be greater than that through duct 76 whereby a progressively slower rate of cooling of the heated part occurs as the part moves from inlet 86 to exit 88.

Because the conveyor 24 permits the cooling air from portion 20 to freely pass therethrough, both the upper and lower sides of the heated part 26 are simultaneously cooled and this bi-directional flow of cooling air upon the heated part permits better control of the cooling rate than is achievable with the usual monodirectional air flow utilized in conventional air quenching systems. As shown in FIG. 3, the cooling air directly flowing upon the upper and lower sides of the heated part 26 is quickly removed through the exhaust manifold orifices 60 and cooling due to uncontrolled air flow within the spacing 22 is minimized which adds to the close regulation of the rate of cooling achieved by the invention.

While the various zones of the rate of cooling through the chamber 12 can be produced solely by regulating the air flow through the air supply ports 44 and the exhaust ports 54, a more definite separation between zones can be achieved by using zone partitions 84, FIG. 4, between air supply and air exhaust components. The zone partitions 84 are vertically oriented and located within both the air supply manifolds 32 and the air exhaust manifolds 34 and prevent the air flowing through the ducts 72, 74 and 76, and the equivalent air supply ducts, from intermixing.

It is appreciated that various modifications to the inventive concepts may be apparent to those skilled in the art without departing from the spirit and scope of the invention.

What is claimed is:

1. An air quenching chamber for uniformly cooling heated parts comprising, in combination, a chamber having upper and lower enclosed portions, said upper portion being vertically spaced above said lower portion, said upper portion having a lower surface and said lower portion having an upper surface in opposed relation to said lower surface, a plurality of air discharge orifices defined in said portions' surfaces, a plurality of air exhaust orifices defined in said surfaces located intermediate said discharge orifices, cooling air supply means in communication with said discharge orifices, air exhaust means in communication with said exhaust orifices, and an air pervious conveyor belt located between said upper and lower chamber portions and surfaces supporting the parts to be cooled by the air being discharged through said discharge orifices.

2. In an air quenching chamber as in claim 1, said conveyor belt having a plurality of openings defined therein whereby air discharged from said lower portion upper surface air discharge orifices will contact the underside of parts supported on said conveyor.

3. In an air quenching chamber as in claim 1, said upper and lower chamber portions each including a substantially horizontal partition dividing the associated chamber portion into an air supply manifold and an air exhaust manifold, said air exhaust manifold of said upper and lower chamber portions being adjacent said chamber portions' surfaces and said air supply manifolds of said upper and lower portions being remote from said chambers portions' surfaces, a plurality of air supply tubes mounted in each chamber portion each having an inlet in communication with the associated air supply manifold and extending through the adjacent air exhaust manifold and each having an outlet extending through the associated chamber surface defining said air discharge orifices.

4. In an air quenching chamber as in claim 3, a nozzle defined in said tubes' outlet shaping the flow of air discharged therethrough.

5. In an air quenching chamber as in claim 3, said air exhaust orifices defined in said chamber surfaces comprises holes defined in said surfaces intermediate said tubes' outlets.

6. In an air quenching chamber as in claim 2, said chamber having first and second ends having a length, said conveyor belt having a part supporting portion extending the length of said chamber, said chamber first end defining a part chamber entrance end, said chamber second end defining a part chamber discharge end, a plurality of cooling air supply means and air exhaust means in communication with said chamber spaced along the length thereof, and means controlling the volume of air flowing through said plurality of cooling air supply means and said air exhaust means whereby the volume of air cooling the part as it moves through the length of the chamber may be varied.

7. In an air quenching chamber as in claim 6, said means controlling the volume of air flowing through said plurality of air supply means and said air exhaust means comprises air damper valves and variable speed fans.

8. In an air quenching chamber as in claim 6, partitions defined in said chamber spaced along the length thereof defining zones within said chamber, at least one of said cooling air supply means and said air exhaust means being in communication with each chamber zone to permit the air supply and air exhaust within each zone to be controlled.

9. The method of air quenching a heated part having opposite sides within an air quenching chamber having an entrance and an exit comprising the steps of:

(a) moving the heated part through the air quenching chamber from the entrance to the exit, (b) simultaneously flowing a cooling air upon the opposite sides of the part, (c) simultaneously removing the air flowing upon the heated part from opposite sides of the part, and (d) flowing a greater amount of cooling air upon the heated part adjacent the chamber entrance than adjacent the chamber exit whereby the heated part is initially rapidly cooled and then permitted to cool at a slower rate.

* * * * *